US009190023B2

(12) United States Patent
Kim

(10) Patent No.: US 9,190,023 B2
(45) Date of Patent: Nov. 17, 2015

(54) LIQUID CRYSTAL DISPLAY DEVICE AND METHOD OF DRIVING THE SAME

(71) Applicant: LG DISPLAY CO., LTD., Seoul (KR)

(72) Inventor: Du-Jin Kim, Gwangju (KR)

(73) Assignee: LG Display Co., Ltd., Seoul (KR)

( * ) Notice: Subject to any disclaimer, the term of this patent is extended or adjusted under 35 U.S.C. 154(b) by 8 days.

(21) Appl. No.: 14/267,431

(22) Filed: May 1, 2014

(65) Prior Publication Data

US 2014/0240308 A1 Aug. 28, 2014

Related U.S. Application Data

(62) Division of application No. 12/003,620, filed on Dec. 28, 2007, now Pat. No. 8,754,836.

(30) Foreign Application Priority Data

Dec. 29, 2006 (KR) ..... 10-2006-0138514
May 9, 2007 (KR) ..... 10-2007-0045036

(51) Int. Cl.
*G09G 3/36* (2006.01)
*G09G 5/18* (2006.01)

(52) U.S. Cl.
CPC ..... *G09G 5/18* (2013.01); *G09G 3/3648* (2013.01); *G09G 3/3696* (2013.01); *G09G 2310/0245* (2013.01); *G09G 2310/0248* (2013.01); *G09G 2310/063* (2013.01); *G09G 2330/02* (2013.01)

(58) Field of Classification Search
CPC ..... G09G 3/18; G09G 3/2003; G09G 3/2007–3/2081; G09G 3/36–3/3696; G09G 2300/0478–2300/0495
See application file for complete search history.

(56) References Cited

U.S. PATENT DOCUMENTS

| | | | | |
|---|---|---|---|---|
| 3,699,360 | A | 10/1972 | Ragsdale | |
| 2001/0009411 | A1 | 7/2001 | Kusanagi | |
| 2001/0033266 | A1 | 10/2001 | Lee | |
| 2005/0062706 | A1* | 3/2005 | Mizumaki | 345/94 |
| 2005/0078102 | A1 | 4/2005 | Kim | |
| 2005/0162917 | A1 | 7/2005 | Yoo | |
| 2005/0179630 | A1 | 8/2005 | Huang | |

(Continued)

FOREIGN PATENT DOCUMENTS

| | | |
|---|---|---|
| CN | 1487494 | 4/2004 |
| JP | 01-170986 | 7/1989 |

(Continued)

OTHER PUBLICATIONS

Taiwanese Office Action with English translation, issued in corresponding Taiwanese patent application.

(Continued)

*Primary Examiner* — Sanghyuk Park
(74) *Attorney, Agent, or Firm* — Morgan, Lewis & Bockius LLP

(57) ABSTRACT

A driving circuit for driving a liquid crystal display device having a plurality of gate lines, data lines and switch elements connected to the gate and data lines includes a data driver for applying a plurality of data signals to the date lines, a gate driver for applying a plurality of gate signals to the gate lines, a timing controller for providing a plurality of control signals to the data and gate drivers, a power supply for generating a power voltage, and a discharging circuit for applying a first signal and a second signal to the gate driver in accordance with the power voltage.

6 Claims, 14 Drawing Sheets

(56) References Cited

U.S. PATENT DOCUMENTS

| | | | | |
|---|---|---|---|---|
| 2006/0092109 | A1* | 5/2006 | Hsu et al. | 345/87 |
| 2008/0100558 | A1 | 5/2008 | Yu | |

FOREIGN PATENT DOCUMENTS

| | | |
|---|---|---|
| JP | 02-272490 | 11/1990 |
| JP | 10-214067 | 8/1998 |
| JP | 2004-226597 | 8/2004 |
| JP | 2004-302159 | 10/2004 |
| TW | I237228 | 8/2005 |

OTHER PUBLICATIONS

Office Action issued in corresponding Chinese Application No. 200710301167.1.

* cited by examiner

LIQUID CRYSTAL DISPLAY DEVICE AND METHOD OF DRIVING THE SAME

This application is a divisional application of copending U.S. application Ser. No. 12/003,620, filed on Dec. 28, 2007, which claims the benefit of Korean Patent Applications No. 10-2006-0138514, filed in Korea on Dec. 29, 2006 and No. 10-2007-0045036 filed in Korea on May 9, 2007, both of which are hereby incorporated by reference in its entirety.

BACKGROUND OF THE INVENTION

1. Field of the Invention

Embodiments of the invention relate to a liquid crystal display device, and more particularly, to a liquid crystal display device and a method of driving the same. Although embodiments of the invention are suitable for a wide scope of applications, they are particularly suitable for obtaining a liquid crystal display device including a discharging circuit and the method of driving the same.

2. Discussion of the Related Art

Liquid crystal display (LCD) devices use the optical anisotropy and polarization properties of liquid crystal molecules to produce an image. The liquid crystal molecules have long and thin shapes, and have the optical anisotropy property, such that the liquid crystal molecules can be aligned along an alignment direction. The liquid crystal molecules also have the polarization property, such that the alignment direction can be changed according to an intensity of an applied electric field. In particular, the arrangement of the liquid crystal molecules can be changed by varying the intensity of the electric field. Consequently, light transmittance of the liquid crystal molecules is controlled by the electric field, and the LCD device displays images due to the changes in light transmittance.

In general, an LCD device includes a liquid crystal panel and a driving circuit. The liquid crystal panel includes first and second substrates spaced apart from each other and a liquid crystal layer between the first and second substrates. The first substrate, which is commonly referred to as an array substrate, has a thin film transistor and a pixel electrode, and the second substrate, which is commonly referred to as a color filter substrate, has a color filter layer and a common electrode. The driving circuit electrically drives the liquid crystal panel. Since the LCD device is a non-emissive type device, the LCD device includes a light source, such as a backlight unit, under the liquid crystal panel.

FIG. 1 is a schematic diagram illustrating an LCD device according to the related art. In FIG. 1, an LCD device includes a liquid crystal panel 10 and a driving circuit 60. The liquid crystal panel 10 includes a plurality of gate lines GL1 to GLn and a plurality of data lines DL1 to DLm. The plurality of gate lines GL1 to GLn cross the plurality of data lines DL1 to DLm to define a plurality of pixel regions, and each pixel region includes a thin film transistor (TFT) T, a liquid crystal capacitor Clc and a storage capacitor Cst to display images.

The driving circuit 60 includes a timing controller 20, a gate driver 30, a data driver 40 and a power supply 50. The timing controller 20 generates data control signals for the data driver 40 including a plurality of data integrated circuits (ICs) and gate control signals for the gate driver 30 including a plurality of gate ICs using a plurality of external signals from an external system. Moreover, the timing controller 20 outputs data signals to the data driver 40.

The gate driver 30 controls ON/OFF operation of the thin film transistors (TFTs) in the liquid crystal panel 10 according to the gate control signals from the timing controller 20.

On-level gate voltages are sequentially applied to the gate lines GL1 to GLn by a single horizontal synchronization time (1H) to enable the gate lines GL1 to GLn and the TFTs connected to the gate lines GL1 to GLn. When the TFTs corresponding to a single gate line are turned on, the data signals are applied to pixels in the pixel regions of the liquid crystal panel 10 through the data lines DL1 to DLm.

The data driver 40 selects reference voltages of the data signals according to the data control signals from the timing controller 20, and supplies the selected reference voltages to the liquid crystal panel 10 to adjust a rotation angle of liquid crystal molecules. The power supply 50 generates and supplies source voltages to the timing controller 20, the gate driver 30 and the data driver 40. In addition, the power supply 50 generates and supplies a common voltage to the liquid crystal panel 10.

When a power of the LCD device is off, the TFTs are also turned off. As a result, the data signals stored in the liquid crystal capacitor Clc and the storage capacitor Cst remain and are not discharged. Since the remaining data signals abnormally drives the liquid crystal panel for a short time, the liquid crystal panel displays undesired residual images or abnormal images.

SUMMARY OF THE INVENTION

Accordingly, embodiments of the invention is directed to a liquid crystal display device and a method of driving the same that substantially obviate one or more of the problems due to limitations and disadvantages of the related art.

An object of the embodiments of the invention is to provide a liquid crystal display device and a method of driving the same that includes a discharging circuit for remaining data signals.

Another object of embodiments of the invention is to provide a liquid crystal display device and a method of driving the same that includes a voltage detecting integrated circuit (IC).

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a driving circuit for driving a liquid crystal display device having a plurality of gate lines, data lines and switch elements connected to the gate and data lines includes a data driver for applying a plurality of data signals to the date lines, a gate driver for applying a plurality of gate signals to the gate lines, a timing controller for providing a plurality of control signals to the data and gate drivers, a power supply for generating a power voltage, and a discharging circuit for applying a first signal and a second signal to the gate driver in accordance with the power voltage.

In another aspect, a method for driving a liquid crystal display device having a plurality of gate lines, a plurality of data lines, a plurality of switch elements connected to the gate and data lines, and a gate driver for driving the gate lines includes generating a power voltage, detecting the power voltage, and when the power voltage is detected to be lower than a reference voltage, applying a first signal to the gate driver, the first signal corresponding to turning on all of the switching elements.

In another aspect, a method for driving a liquid crystal display device having a plurality of gate lines, a plurality of data lines, a plurality of switch elements connected to the gate and data lines, and a gate driver for driving the gate lines includes during an operation mode, generating a power voltage and enabling sequentially the switching elements in a row-by-row manner based on the power voltage, and after the operation mode when the power voltage is below a reference voltage, enabling all the switching elements synchronously for a discharging period.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention. In the drawings.

DETAILED DESCRIPTION OF THE PREFERRED EMBODIMENTS

Reference will now be made in detail to the preferred embodiments of the invention, examples of which are illustrated in the accompanying drawings.

Figure 1:
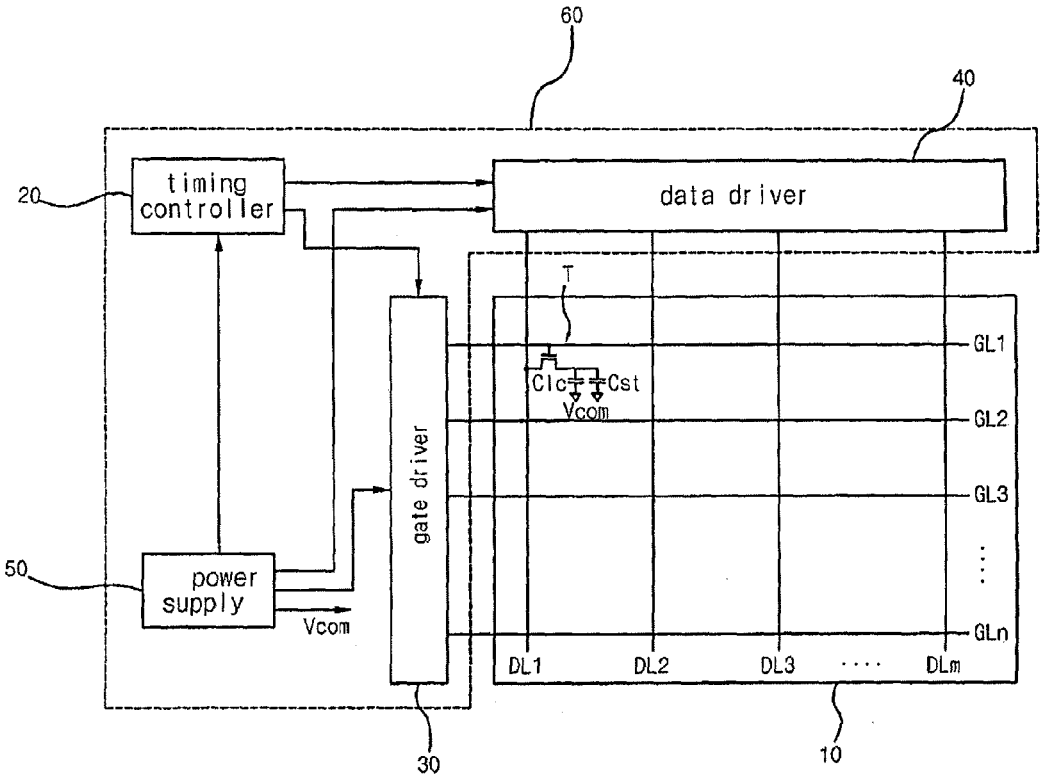
FIG. 1 RELATED ART
FIG. 1 is a schematic diagram illustrating an LCD device according to the related art.
Figure 2:
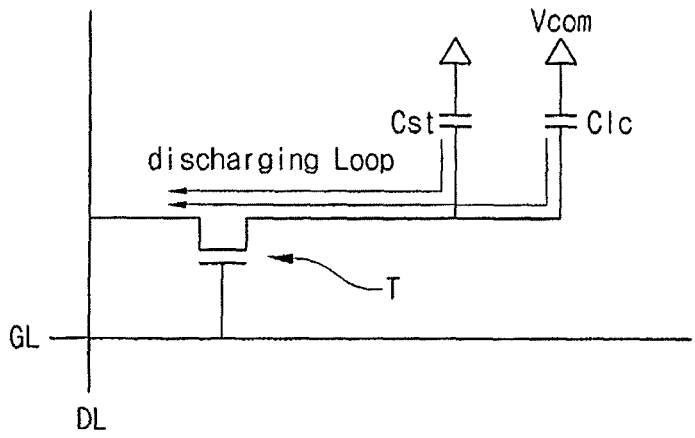
FIG. 2 is a circuit diagram schematically illustrating a discharging loop of remaining data signals in an LCD device according to an embodiment of the invention.

A liquid crystal display (LCD) device according to an embodiment of the invention includes a discharging circuit to solve the problems of the residual images or the abnormal images. FIG. 2 is a circuit diagram schematically illustrating a discharging loop of remaining data signals in an LCD device according to an embodiment of the invention. In FIG. 2, after a power of the LCD device is off, a discharging circuit (not shown) applies an on-level gate voltage to a gate line GL during a predetermined time period and a thin film transistor (TFT) T is turned on. As a result, data signals remaining in a liquid crystal capacitor Clc and a storage capacitor Cst are discharged.

Figure 3:
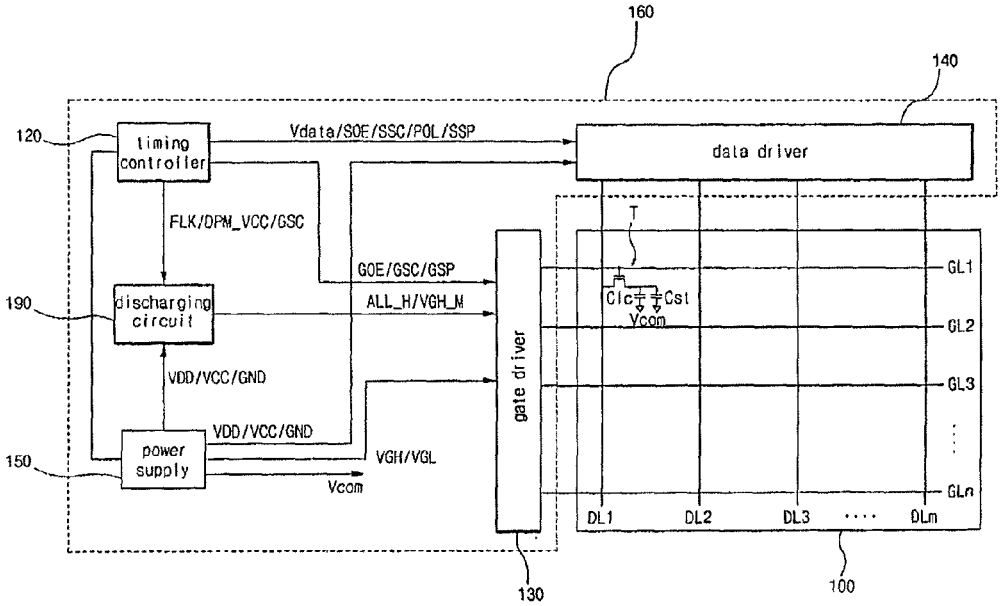
FIG. 3 is a schematic diagram illustrating an LCD device according to an embodiment of the invention.

FIG. 3 is a schematic diagram illustrating an LCD device according to an embodiment of the invention. In FIG. 3, an LCD device includes a liquid crystal panel 100 displaying images and a driving circuit 160 for the liquid crystal panel 100. The liquid crystal panel 100 includes a plurality of gate lines GL1 to GLn and a plurality of data lines DL1 to DLm. The plurality of gate lines GL1 to GLn cross the plurality of data lines DL1 to DLm to define a plurality of pixel regions, and each pixel region includes a thin film transistor (TFT) T, a liquid crystal capacitor Clc and a storage capacitor Cst to display images.

The driving circuit 160 includes a timing controller 120, a gate driver 130, a data driver 140, a power supply 150 and a discharging circuit 190. The timing controller 120 generates gate control signals for the gate driver 130 including a plurality of gate integrated circuits (ICs) and data control signals for the data driver 140 including a plurality of data ICs using a plurality of external signal from an external system. The gate control signals may include a gate output enable signal GOE, a gate shift clock signal GSC and gate start pulse signal GSP, and the data control signals may include a source output enable signal SOE, a source sampling clock signal SSC, a polarity reverse signal POL and a source start pulse signal SSP. Moreover, the timing controller 120 outputs data signals Vdata to the data driver 140. In addition, the timing controller 120 generates a flicker signal FLK and a DPM maintenance signal DPM_VCC for the discharging circuit 190 and supplies the flicker signal FLK, the DPM maintenance signal DPM_VCC and the gate shift clock signal GSC to the discharging circuit 190.

The gate driver 130 controls ON/OFF operation of the thin film transistors (TFTs) in the liquid crystal panel 100 according to the gate control signals from the timing controller 120. On-level gate voltages are sequentially applied to the gate lines GL1 to GLn by a single horizontal synchronization time (1H) to enable the gate lines GL1 to GLn and the TFTs connected to the gate lines GL1 to GLn. When the TFTs corresponding to a single gate line are turned on, the data signals are applied to pixels in the pixel regions of the liquid crystal panel 100 through the data lines DL1 to DLm.

The data driver 140 selects reference voltages of the data signals according to the data control signals from the timing controller 120, and supplies the selected reference voltages to the liquid crystal panel 100 to adjust a rotation angle of liquid crystal molecules. The power supply 150 generates and supplies first, second and third source voltages VCC, VDD and GND to the timing controller 120, the data driver 140 and the discharging circuit 190. Further, the power supply 150 generates and supplies a gate high voltage VGH and a gate low voltage VGL to the gate driver 130 to turn on and off the TFTs and a common voltage Vcom to the liquid crystal panel 100.

The discharging circuit 190 includes four partial circuits generating and maintaining a discharging signal ALL_H during a predetermined time period. For example, when the first source voltage VCC is lower than an off-reference voltage, the discharging circuit 190 generates and supplies the discharging signal ALL_H to the gate driver 130. The off-reference voltage may be of 2.5 V. The gate driver 130 applies the gate high voltage VGH to all the gate lines GL1 to GLn according to the discharging signal ALL_H to turn on all the TFTs. Moreover, the discharging circuit 190 generates a discharging maintenance signal VGH_M to maintain the discharging signal ALL_H during the predetermined time period and supplies the discharging maintenance signal VGH_M to the gate driver 130. For example, the predetermined time period may be over than 3 msec.

Figure 4:
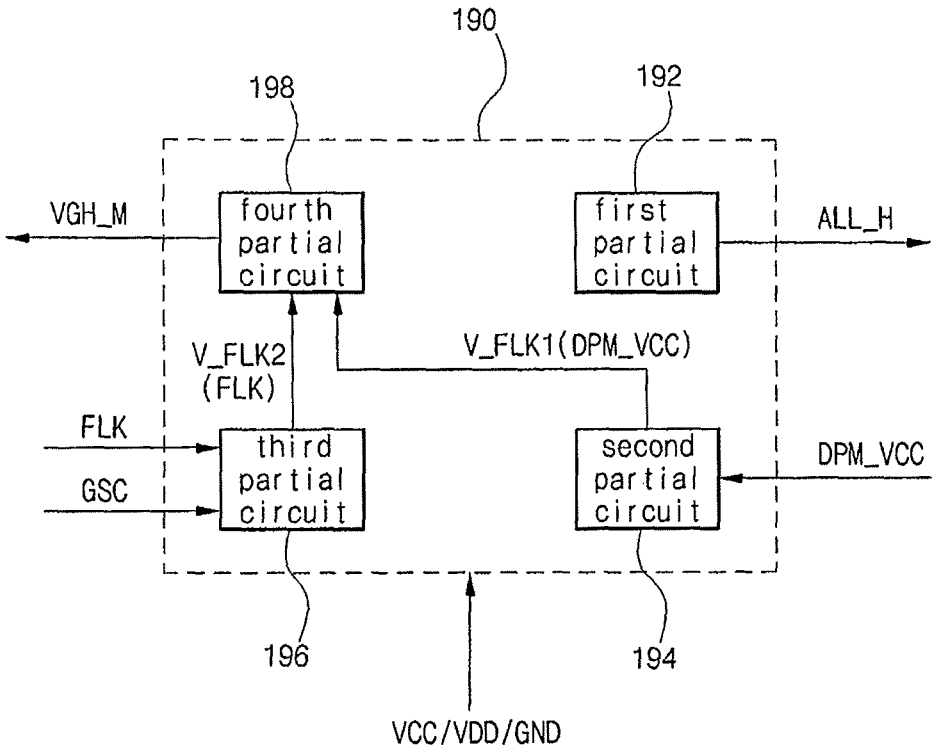
FIG. 4 is a block diagram schematically illustrating a discharging circuit for an LCD device according to an embodiment of the invention.
Figure 5A:
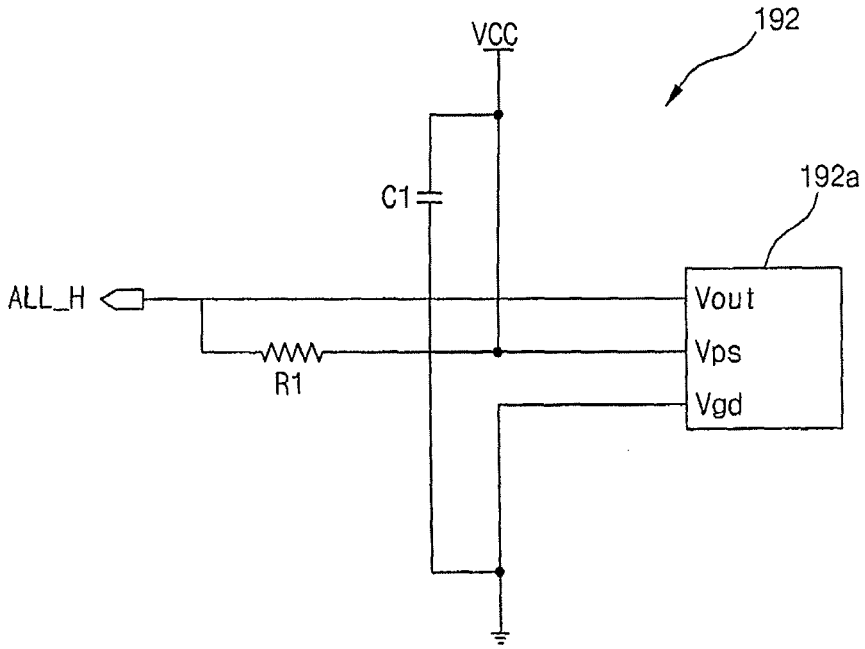
FIGS. 5A to 5C are circuit diagrams schematically illustrating first to third partial circuits, respectively, of a discharging circuit for an LCD device according to an embodiment of the invention.
Figure 5B:
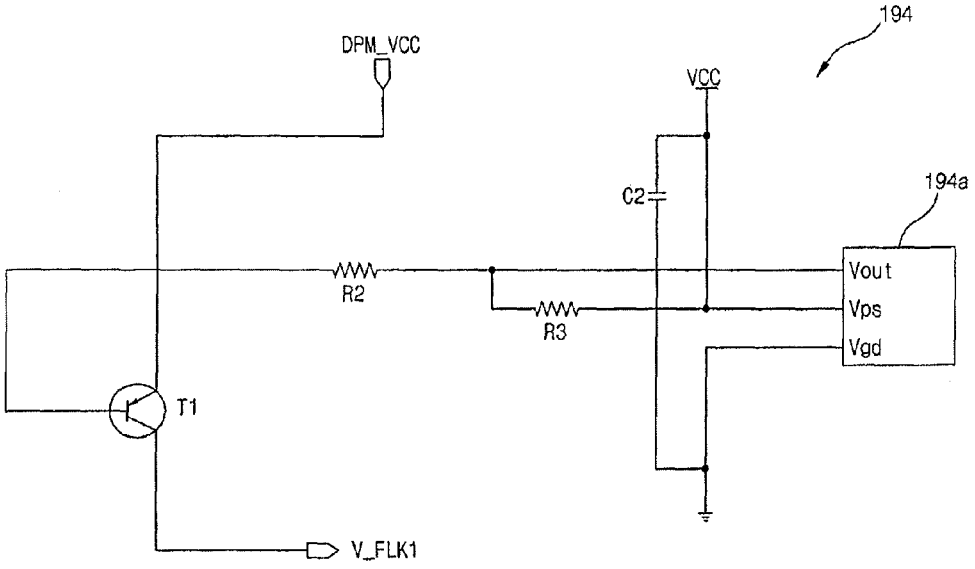
Figure 5C:
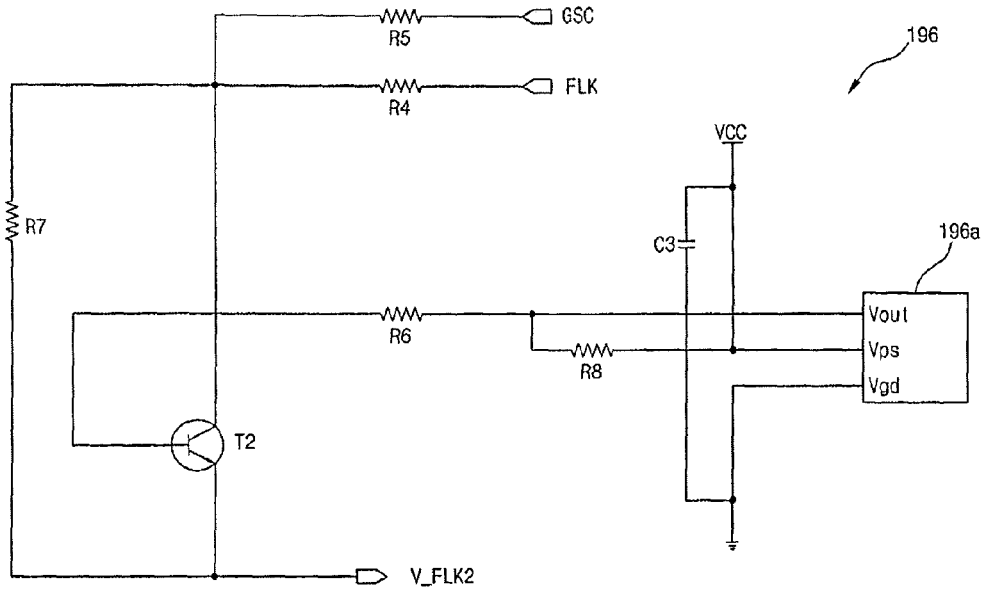

FIG. 4 is a block diagram schematically illustrating a discharging circuit for an LCD device according to an embodiment of the invention, and FIGS. 5A to 5C are circuit diagrams schematically illustrating first to third partial circuits, respectively, of a discharging circuit for an LCD device according to an embodiment of the invention. In FIG. 4, the discharging circuit 190 includes first, second, third and fourth partial circuits 192, 194, 196 and 198 and receives first, second and third source voltages VCC, VDD and GND. When the first source voltage VCC becomes lower than the off-reference voltage, the first partial circuit 192 outputs the discharging signal ALL_H to the gate driver 120 (of FIG. 3). The off-reference voltage may be about 2.5 V.

As shown in FIG. 5A, for example, the first partial circuit 192 may include a first voltage detecting integrated circuit (IC) 192*a*. The first voltage detecting IC 192*a* may have a power source input terminal Vps, an output terminal Vout and a ground terminal Vgd. The first partial circuit 192 may further include a first capacitor C1 and a first resistor R1 connected to the first voltage detecting IC 192*a*.

Referring again to FIG. 4, when the first source voltage VCC becomes lower than the off-reference voltage, the second partial circuit 194 generates and supplies a power modulating signal (DPM) maintenance signal DPM_VCC as a first varied flicker signal V_FLK1 to the fourth partial circuit 198. The DPM maintenance signal DPM_VCC maintains a power modulating signal DPM during the predetermined time period, where the power modulating signal DPM is used to control the source voltages. The power modulating signal that determines a starting timing of the data signals DPM may be about 1.6 V. For example, the source voltages may be applied when the power modulating signal DPM has a high level voltage and the source voltages may be not applied when the power modulating signal DPM has a low level voltage.

As shown in FIG. 5B, the second partial circuit 194 may include a second voltage detecting IC 194*a*, a second capacitor C2, a second resistor R2, a third resistor R3 and a first transistor T1. The second voltage detecting IC 194*a* may have an output terminal Vout, a power source input terminal Vps and a ground terminal Vgd, and the first transistor T1 may have a positive-negative-positive (PNP) bipolar type. Since the output terminal Vout of the second voltage detecting IC 194*a* is connected to a base of the first transistor T1, the second voltage detecting IC 194*a* controls the first transistor T1 and determines the DPM maintenance signal DPM_VCC as the first varied flicker signal V_FLK1 through the first transistor T1. For example, when the first source voltage VCC is lower than the off-reference voltage, the DPM maintenance signal DPM_VCC is outputted from the second partial circuit 194 as the first varied flicker signal V_FLK1.

Referring back to FIG. 4, when the first source voltage VCC is higher than the off-reference voltage, the third partial circuit 196 generates and supplies a flicker signal FLK as a second varied flicker signal V_FLK2 to the fourth partial circuit 198. Accordingly, the third partial circuit 196 receives the flicker signal FLK and a gate shift clock signal GSC and controls the supply of the flicker signal FLK as the second varied flicker signal V_FLK2. The flicker signal FLK is used to prevent a flicker phenomenon in the liquid crystal panel. For example, a rear portion of a gate pulse may be reduced according to the flicker signal FLK, such that the gate pulse has a high level voltage in a long front section of a single period corresponding to the gate shift clock signal GSC and has a low level voltage in a short rear section of the single period. As a result, the third partial circuit 196 supplies the flicker signal FLK from the timing controller 120 (of FIG. 3) as the second varied flicker signal V_FLK2 to the fourth partial circuit 198 when the source voltage VCC is higher than the off-reference voltage, and does not supply the flicker signal FLK to the fourth partial 198 when the source voltage VCC is lower than the off-reference voltage. Alternatively, the gate shift clock signal GSC instead of the flicker signal FLK may be supplied as the second varied flicker signal V_FLK2.

As shown in FIG. 5C, the third partial circuit 196 may include a third voltage detecting IC 196*a*, a third capacitor C3, fourth to eighth resistors R4 to R8 and a second transistor T2. The third voltage detecting IC 196*a* may have an output terminal Vout, a power source input terminal Vps and a ground terminal Vgd, and the second transistor T2 may have a negative-positive-negative (NPN) bipolar type. Since the output terminal Vout of the third voltage detecting IC 196*a* is connected to a base of the second transistor T2, the third voltage detecting IC 196*a* controls the second transistor T2 and determines the flicker signal FLK as the second varied flicker signal V_FLK2. For example, when the first source voltage VCC is higher than the off-reference voltage, the flicker signal FLK is outputted from the third partial circuit 196 as the second varied flicker signal V_FLK2. In addition, when the first source voltage VCC is lower than the off-reference voltage, the flicker signal FLK is not outputted from the third partial circuit 196 as the second varied flicker signal V_FLK2. Instead, the second partial circuit 194 outputs the DPM maintenance signal DPM_VCC as the first varied flicker signal V_FLK1.

Referring back to FIG. 4, the fourth partial circuit 198 that is a power block generates and supplies the discharging maintenance signal VGH_M according to the first and second varied flicker signals V_FLK1 and V_FLK2 to the gate driver 130 (of FIG. 3). Accordingly, when the first source voltage VCC is higher than the off-reference voltage and the LCD device is powered on, the fourth partial circuit 198 modulates the gate signal with the flicker signal FLK to generate the discharging maintenance signal VGH_M and the discharging maintenance signal VGH_M is supplied to the gate driver 130 (of FIG. 3) to operate the LCD device without flicker. When the first source voltage VCC is lower than the off-reference voltage and the LCD device is powered off, the fourth partial circuit 198 modulates the gate signal with the DPM maintenance signal DPM_VCC to generate the discharging maintenance signal VGH_M and the discharging maintenance signal VGH_M is supplied to the gate driver 130 (of FIG. 3) to determine the predetermined time period for the discharging signal ALL_H. Although not shown, at least two of the first to third voltage detecting ICs 192*a*, 194*a* and 196*a* may be formed as a single IC.

Figure 6:
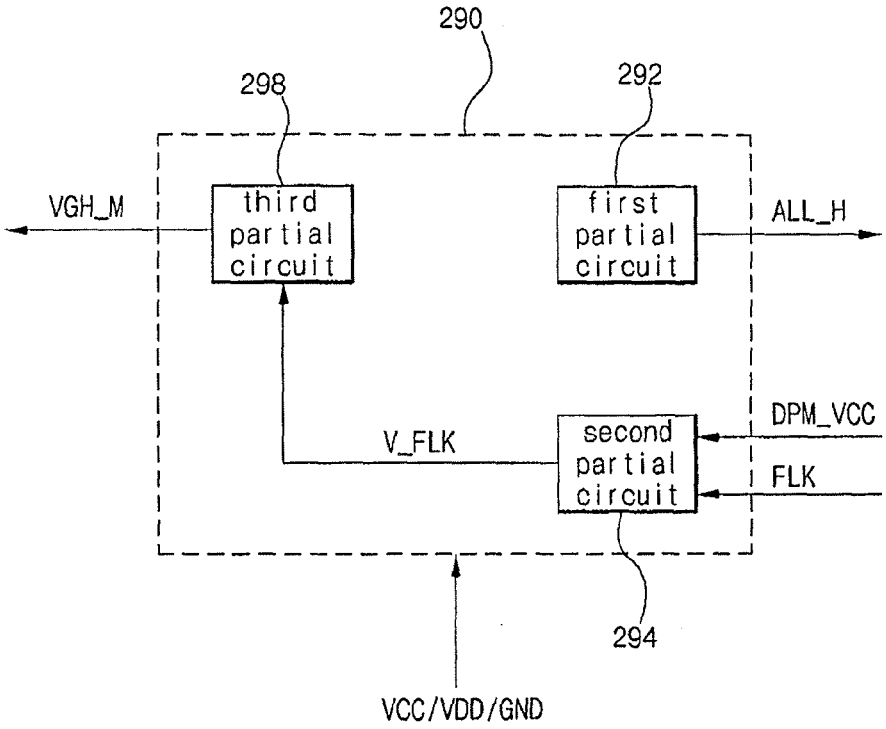
FIG. 6 is a block diagram schematically illustrating a discharging circuit for an LCD device according to another embodiment of the invention.
Figure 7A:
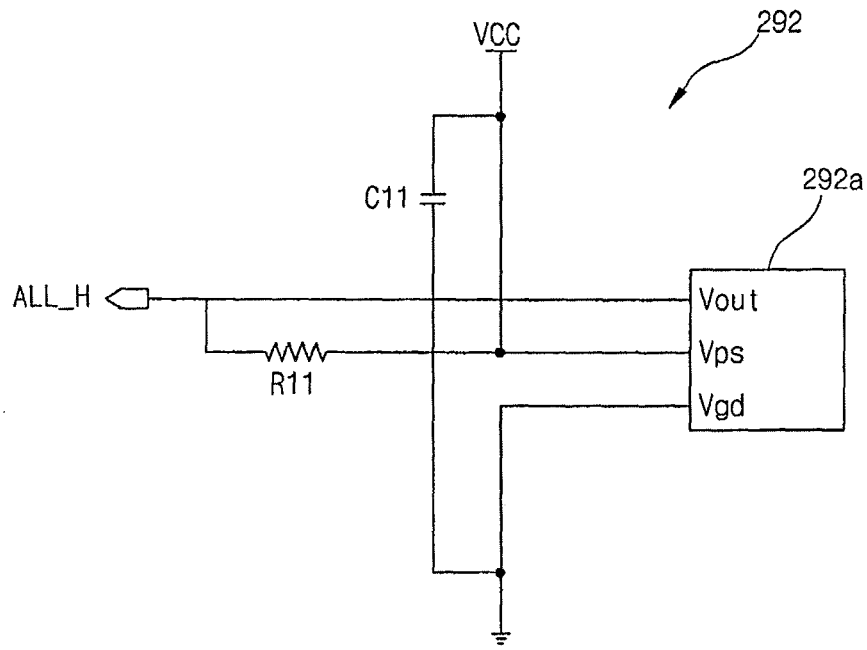
FIGS. 7A and 7B are circuit diagrams schematically illustrating first and second partial circuits, respectively, of a discharging circuit for an LCD device according to another embodiment of the invention.
Figure 7B:
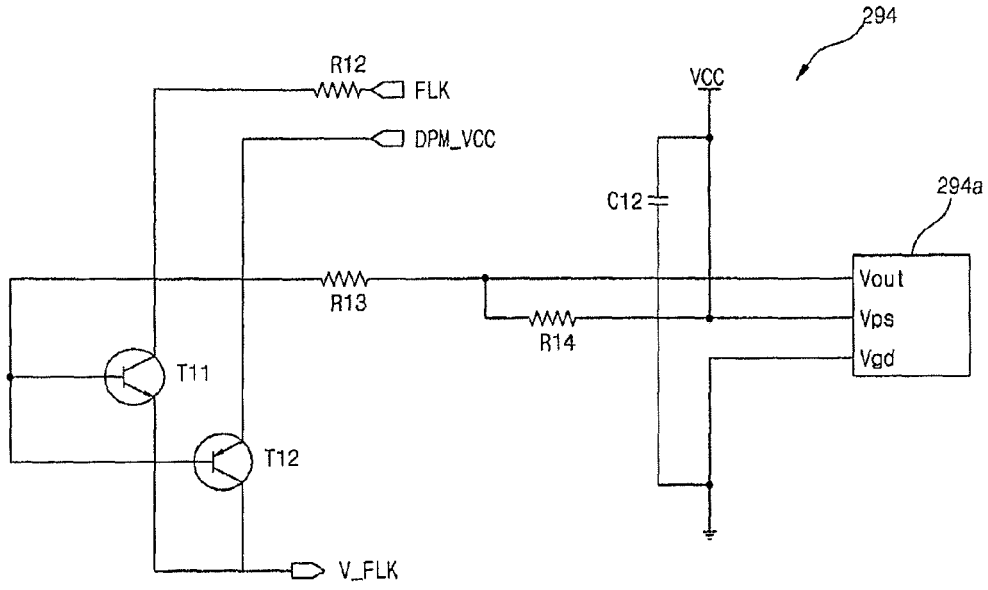

FIG. 6 is a block diagram schematically illustrating a discharging circuit for an LCD device according to another embodiment of the invention, and FIGS. 7A and 7B are circuit diagrams schematically illustrating first and second partial circuits, respectively, of a discharging circuit for an LCD device according to another embodiment of the invention. In FIG. 6, the discharging circuit 290 includes first, second and third partial circuits 292, 294 and 298 and receives first, second and third source voltages VCC, VDD and GND. When the first source voltage VCC becomes lower than the off-reference voltage, the first partial circuit 292 outputs the discharging signal ALL_H to the gate driver (not shown). The off-reference voltage may be about 2.5 V. In addition, the second partial circuit 294 supplies the third partial circuit 298 with a flicker signal FLK from a timing controller (not shown) as a varied flicker signal V_FLK when the source voltage VCC is higher than the off-reference voltage and with a DPM maintenance signal DPM_VCC as the varied flicker signal V_FLK when the source voltage VCC is lower than the off-reference voltage. Similarly to the fourth partial circuit 198 (of FIG. 4), the third partial circuit 298 that is a power block generates and supplies a discharging maintenance signal VGH_M according to the varied flicker signals V_FLK to the gate driver 130 (of FIG. 3).

As shown in FIG. 7A, for example, the first partial circuit 292 may include a first voltage detecting integrated circuit (IC) 292*a*. The first voltage detecting IC 292*a* may have a power source input terminal Vps, an output terminal Vout and a ground terminal Vgd. The first partial circuit 292 may further include a first capacitor C11 and a first resistor R11 connected to the first voltage detecting IC 292*a*.

As shown in FIG. 7B, for example, the second partial circuit 294 includes a voltage detecting integrated circuit (IC) 292*a*, a second capacitor C12, second to fourth resistors R12 to R14 and first and second transistors T11 and T12. The voltage detecting IC 292*a* has an output terminal Vout, a power source input terminal Vps and a ground terminal Vgd. In addition, the first transistor T11 may have negative-positive-negative (NPN) bipolar type and the second transistor T12 may have positive-negative-positive (PNP) bipolar type. A base of the first transistor T11 is connected to the output terminal Vout of the voltage detecting IC 292*a* through the third resistor R13 and the flicker signal FLK is inputted to a collector of the first transistor T11 through the second resistor R12. Further, a base of the second transistor T12 is connected to the output terminal of the voltage detecting IC 292*a* through the third resistor R13 and the DPM maintenance signal DPM_VCC is inputted to an emitter of the second transistor T12. An emitter of the first transistor T11 and a collector of the second transistor T12 alternately output the flicker signal FLK and the DPM maintenance signal DPM_VCC as the varied flicker signals V_FLK. Accordingly, the collector of the first transistor T11 and the emitter of the second transistor T12 may be connected to the timing controller 120 (of FIG. 3), and the emitter of the first transistor T11 and the collector of the second transistor T12 may be connected to the second partial circuit 298 (of FIG. 6).

One of a high level voltage and a low level voltage may be outputted from the output terminal Vout of the voltage detecting IC 292*a* according to the first source voltage VCC. A value of the varied flicker signal V_FLK of the first partial circuit 292 and states of the first and second transistors T11 and T12 according to the first source voltage VCC are shown is shown in TABLE 1.

TABLE 1

| VCC | T1 | T2 | V_FLK |
|---|---|---|---|
| ON | ON | OFF | FLK |
| OFF | OFF | ON | DPM_VCC |

In TABLE 1, the first source voltage VCC is higher than the off-reference voltage when the ON state and is lower than the off-reference voltage when the OFF state. In the ON state of the first source voltage VCC, the first transistor T11 is turned on and the second transistor T12 is turned off. In the OFF state of the first source voltage VCC, the first transistor T11 is turned off and the second transistor T12 is turned on. As a result, the first partial circuit 292 outputs the flicker signal FLK in the ON state of the first source voltage VCC and outputs the DPM maintenance signal DPM_VCC in the OFF state of the source voltage VCC as the varied flicker signal V_FLK. Accordingly, the first partial circuit 292 of FIG. 6 having a single voltage detecting IC 292*a* has the same function as the first, second and third partial circuits 192, 194 and 196 of FIG. 4 having the first, second and third voltage detecting ICs 192*a*, 194*a* and 196*a*.

Figure 8:
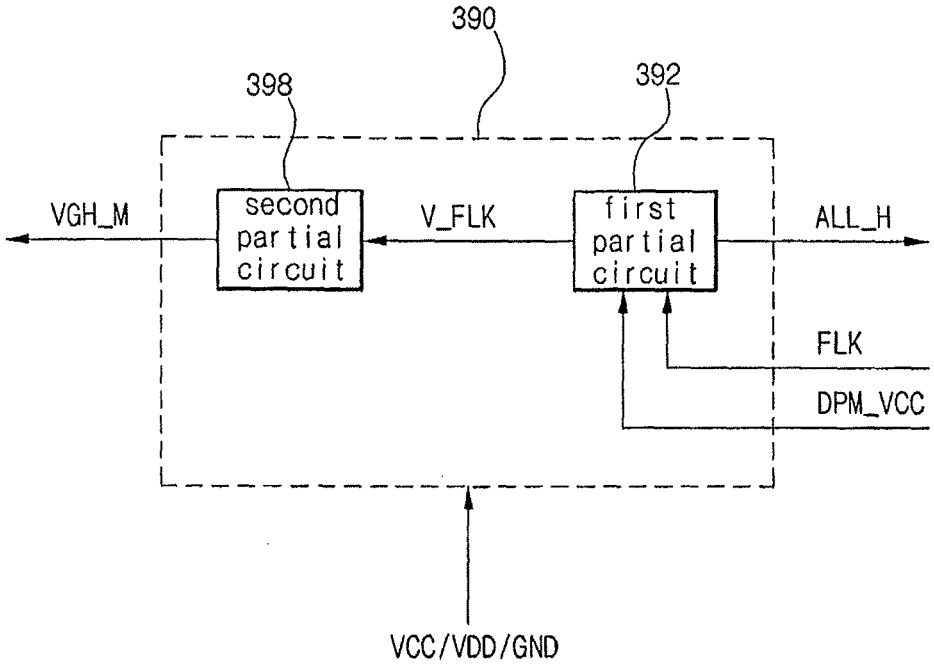
FIG. 8 is a block diagram schematically illustrating a discharging circuit for an LCD device according to another embodiment of the invention.

FIG. 8 is a block diagram schematically illustrating a discharging circuit for an LCD device according to another embodiment of the invention. Although not shown in FIG. 8, the LCD device includes a liquid crystal panel and driving circuit elements such as a timing controller, a gate driver, a data driver and a power supply. In FIG. 8, a discharging circuit 390 includes first and second partial circuits 392 and 398 and receives first, second and third source voltages VCC, VDD and GND. The first partial circuit 392 outputs a discharging signal ALL_H to the gate driver (not shown) when the first source voltage VCC is lower than an off-reference voltage. The off-reference voltage may be about 2.5 V. In addition, the first partial circuit 392 supplies the second partial circuit 398 with a flicker signal FLK from a timing controller (not shown) as a varied flicker signal V_FLK when the source voltage VCC is higher than the off-reference voltage and with a DPM maintenance signal DPM_VCC as the varied flicker signal V_FLK when the source voltage VCC is lower than the off-reference voltage. Similarly to the fourth partial circuit 198 (of FIG. 4), the second partial circuit 398 that is a power block generates and supplies a discharging maintenance signal VGH_M according to the varied flicker signals V_FLK to the gate driver 130 (of FIG. 3).

Figure 9:
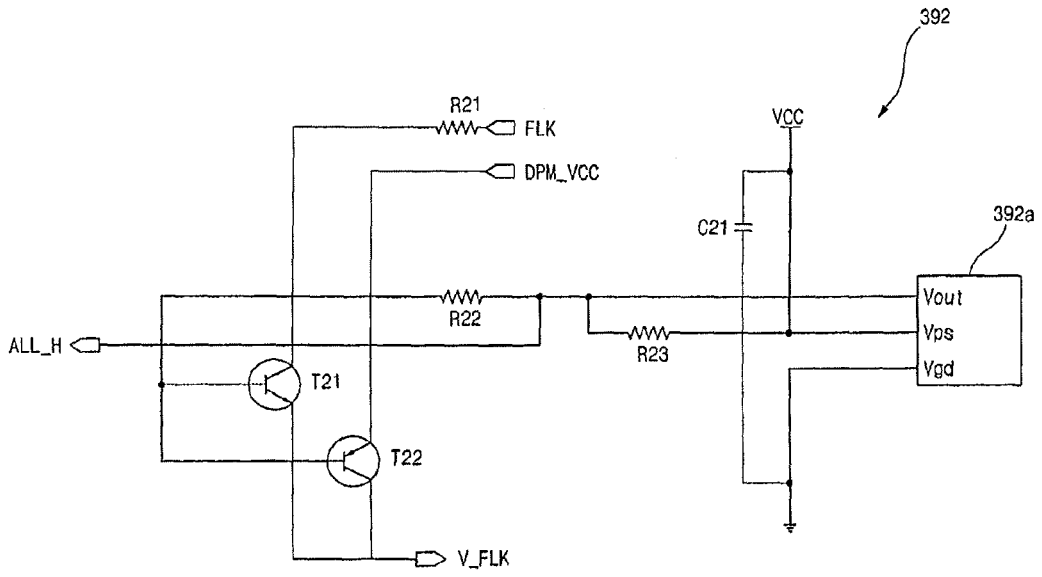
FIG. 9 is a circuit diagram schematically illustrating a first partial circuit of a discharging circuit for an LCD device according to another embodiment of the invention

FIG. 9 is a circuit diagram schematically illustrating a first partial circuit of a discharging circuit for an LCD device according to another embodiment of the invention. As shown in FIG. 9, the first partial circuit 392 includes a voltage detecting integrated circuit (IC) 392*a*, a first capacitor C21, first to third resistors R21 to R23 and first and second transistors T21 and T22. The voltage detecting IC 292*a* has an output terminal Vout, a power source input terminal Vps and a ground terminal Vgd. In addition, the first transistor T21 may have negative-positive-negative (NPN) bipolar type and the second transistor T22 may have positive-negative-positive (PNP) bipolar type. A base of the first transistor T21 is connected to the output terminal Vout of the voltage detecting IC 392*a* through the second resistor R22 and the flicker signal FLK is inputted to a collector of the first transistor T21 through the first resistor R21. Further, a base of the second transistor T22 is connected to the output terminal of the voltage detecting IC 392*a* through the second resistor R22 and the DPM maintenance signal DPM_VCC is inputted to an emitter of the second transistor T22. An emitter of the first transistor T21 and a collector of the second transistor T22 alternately output the flicker signal FLK and the DPM maintenance signal DPM_VCC as the varied flicker signals V_FLK. Accordingly, the collector of the first transistor T21 and the emitter of the second transistor T22 may be connected to the timing controller 120 (of FIG. 3), and the emitter of the first transistor T21 and the collector of the second transistor T22 may be connected to the second partial circuit 398 (of FIG. 8).

One of a high level voltage and a low level voltage may be outputted from the output terminal Vout of the voltage detecting IC 392*a* according to the first source voltage VCC. A value of the varied flicker signal V_FLK of the first partial circuit 392 and states of the first and second transistors T21 and T22 according to the first source voltage VCC are shown is shown in TABLE 2.

TABLE 2

| VCC | T21 | T22 | V_FLK |
|---|---|---|---|
| ON | ON | OFF | FLK |
| OFF | OFF | ON | DPM_VCC |

In TABLE 2, the first source voltage VCC is higher than the off-reference voltage when the ON state and is lower than the off-reference voltage when the OFF state. In the ON state of the first source voltage VCC, the first transistor T21 is turned on and the second transistor T22 is turned off. In the OFF state of the first source voltage VCC, the first transistor T21 is turned off and the second transistor T22 is turned on. As a result, the first partial circuit 392 outputs the flicker signal FLK in the ON state of the first source voltage VCC and outputs the DPM maintenance signal DPM_VCC in the OFF state of the source voltage VCC as the varied flicker signal V_FLK. Accordingly, the first partial circuit 392 of FIG. 8 having a single voltage detecting IC 392*a* has the same function as the first, second and third partial circuits 192, 194 and 196 of FIG. 4 having the first, second and third voltage detecting ICs 192*a*, 194*a* and 196*a*.

Figure 10:
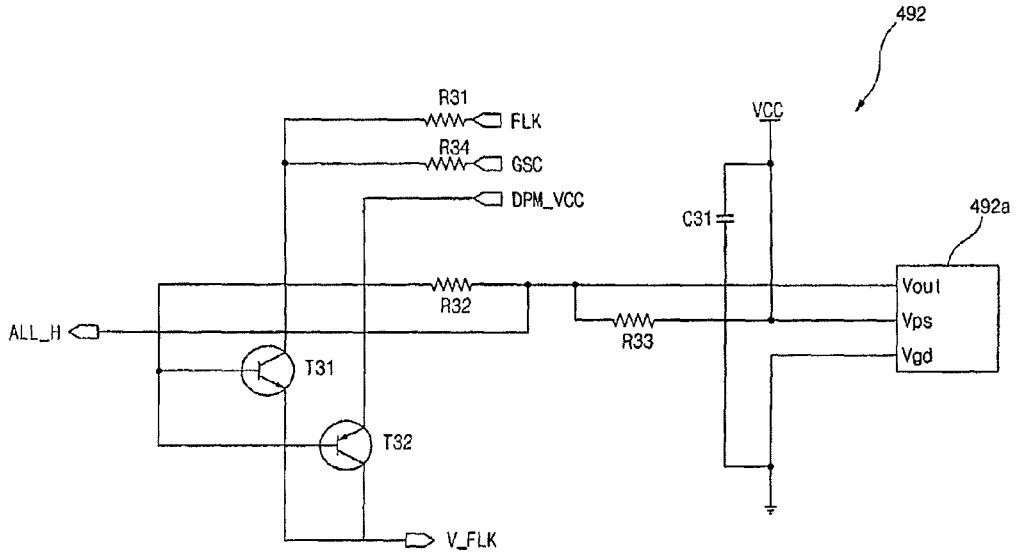
FIG. 10 is a circuit diagram schematically illustrating a partial circuit of a discharging circuit for an LCD device according to another embodiment of the invention.

FIG. 10 is a circuit diagram schematically illustrating a partial circuit of a discharging circuit for an LCD device according to another embodiment of the invention. As shown in FIG. 10, the first partial circuit 492 has elements similar to those of the first partial circuit 392 of FIG. 9. Accordingly, the first partial circuit 492 includes a voltage detecting integrated circuit (IC) 492*a*, a first capacitor C31, first to fourth resistors R31 to R34 and first and second transistors T31 and T32. The voltage detecting IC 492*a* has an output terminal Vout, a power source input terminal Vps and a ground terminal Vgd. In addition, the first transistor T31 may have negative-positive-negative (NPN) bipolar type and the second transistor T32 may have positive-negative-positive (PNP) bipolar type.

In the first partial circuit 492, at least one of the flicker signal FLK and the gate shirt clock signal GSC of the timing controller 120 (of FIG. 3) is inputted to a collector of the first transistor T31 through the first resistor R31 and the fourth resistor R34, respectively. Accordingly, when the first source voltage VCC is higher than the off-reference voltage, the first transistor T31 outputs at least one of the flicker signal FLK and the gate shift clock signal GSC as a varied flicker signal V_FLK. As a result, the first transistor T31 and the second transistor T32 alternately output the flicker signal FLK and the DPM maintenance signal DPM_VCC as the varied flicker signals V_FLK to a second partial circuit (not shown).

Figure 11:
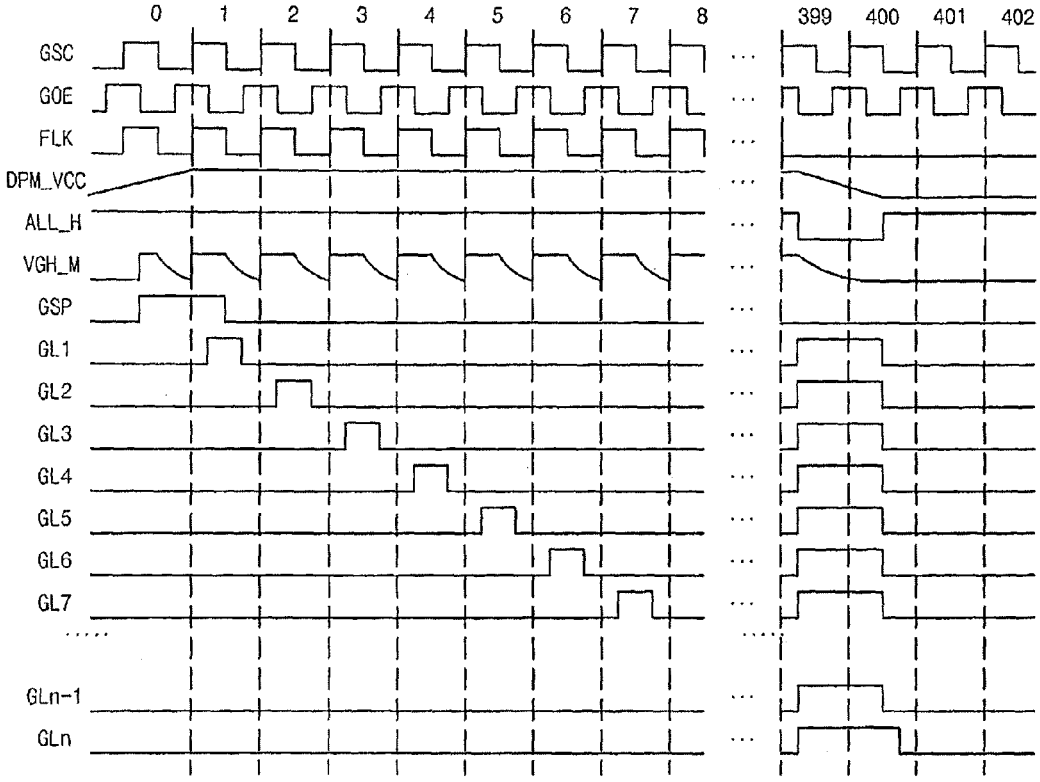
FIG. 11 is a timing chart schematically illustrating a plurality of signals for driving an LCD device according to another embodiment of the invention.

FIG. 11 is a timing chart schematically illustrating a plurality of signals for driving an LCD device according to another embodiment of the invention. In FIG. 11, after a gate shift clock signal GSC followed by a predetermined delay time is enabled, a plurality of gate lines GL1 to GLn are sequentially enabled synchronized with the gate shift clock signal GSC when a gate signal has a gate high voltage VGH. A gate output enable signal GOE divides the gate signals for the plurality of gate lines GL1 to GLn. When the LCD device is off, a first source voltage VCC (of FIG. 8) becomes lower than an off-reference voltage and a discharging circuit 390 (of FIG. 8) outputs a discharging signal ALL_H having a low level voltage for a predetermined time period over about 3 msec. The off-reference voltage may be about 2.5V. As a result, all the plurality of gate lines GL1 to GLn is enabled synchronously with the low level voltage of the discharging signal ALL_H. Accordingly, all the TFTs in the liquid crystal panel are turned on to discharge the pixels sufficiently.

At least one of the flicker signal FLK and the gate shift clock signal GSC synchronous with each other is used to generate a discharging maintenance signal VGH_M when the first source voltage VCC is higher than the off-reference voltage (ON state). In addition, a DPM maintenance signal DPM_VCC determining the predetermined time period for discharging is used to generate the discharging maintenance signal VGH_M when the first source voltage VCC is lower than the off-reference voltage (OFF state). Consequently, in the LCD device according to an embodiment of the invention, display of abnormal images is prevented due to a discharging circuit discharging the pixels after the LCD device is off. In addition, since the discharging circuit includes a single voltage detecting IC, the driving circuit of the LCD device is simplified and production cost of the LCD device is reduced.

It will be apparent to those skilled in the art that various modifications and variations can be made in the liquid crystal display device and the method of driving the same of embodiments of the invention without departing from the spirit or scope of the invention. Thus, it is intended that embodiments of the invention cover the modifications and variations of this invention provided they come within the scope of the appended claims and their equivalents.

What is claimed is:

1. A driving circuit for driving a liquid crystal display device having a plurality of gate lines, data lines and switch elements connected to the gate and data lines, comprising:

a data driver for applying a plurality of data signals to the data lines;

a gate driver for applying a plurality of gate signals to the gate lines;

a timing controller for providing a plurality of control signals to the data and gate drivers;

a power supply for generating a power voltage; and a discharging circuit for applying a first signal and a second signal to the gate driver in accordance with the power voltage, wherein the discharging circuit includes:

a first partial circuit for comparing the power voltage to a reference voltage and outputting the first signal when the power voltage is below the reference voltage;

a second partial circuit for receiving a maintenance signal for determining a predetermined time period for the first signal and for comparing the power voltage to the reference voltage, wherein the second partial circuit outputs the maintenance signal in response to the timing controller when the power voltage is below the reference voltage;

a third partial circuit for receiving a control signal for reducing a rear portion of a gate pulse of the plurality of gate signals and for comparing the power voltage to the reference voltage, wherein the third partial circuit outputs the control signal in response to the timing controller when the power voltage is higher than the reference voltage; and a fourth partial circuit for receiving one of the maintenance signal from the second partial circuit and the control signal from the third partial circuit and for generating the second signal according to the one of the maintenance signal and the control signal.

2. The device according to claim 1, wherein the first partial circuit includes a first capacitor and a first voltage detecting integrated circuit, the second partial circuit includes a second capacitor, a first transistor and a second voltage detecting integrated circuit, and the third partial circuit includes a third capacitor, a second transistor and a third voltage detecting integrated circuit.

3. The device according to claim 1, wherein the control signal is based on one of a gate shift clock signal and a flicker signal from the timing controller.

4. A driving circuit for driving a liquid crystal display device having a plurality of gate lines, data lines and switch elements connected to the gate and data lines, comprising:

a data driver for applying a plurality of data signals to the data lines;

a gate driver for applying a plurality of gate signals to the gate lines;

a timing controller for providing a plurality of control signals to the data and gate drivers;

a power supply for generating a power voltage; and a discharging circuit for applying a first signal and a second signal to the gate driver in accordance with the power voltage, wherein the discharging circuit includes:

a first partial circuit for comparing the power voltage to a reference voltage, outputting the first signal when the power voltage is below the reference voltage;

a second partial circuit for receiving a maintenance signal for determining a predetermined time period for the first signal and a control signal for reducing a rear portion of a gate pulse of the plurality of gate signals and for comparing the power voltage to the reference voltage, wherein the second partial circuit outputs the maintenance signal in response to the timing controller when the power voltage is below the reference voltage, and outputs the control signal in response to the timing controller when the power voltage is higher than the reference voltage; and a third partial circuit for receiving one of the maintenance signal and the control signal from the second partial circuit and for generating the second signal according to the one of the maintenance signal and the control signal.

5. The device according to claim 4, wherein the first partial circuit includes a first capacitor and a first voltage detecting IC, and the second partial circuit includes a second capacitor, a first transistor, a second transistor and a second voltage detecting integrated circuit.

6. The device according to claim 4, wherein the control signal is based on one of a gate shift clock signal and a flicker signal from the timing controller.

* * * * *